US008803038B2

(12) United States Patent
Nakazawa et al.

(10) Patent No.: US 8,803,038 B2
(45) Date of Patent: Aug. 12, 2014

(54) APPARATUS FOR IMAGE FORMATION

(75) Inventors: Masanori Nakazawa, Yamato-Koriyama (JP); Kentaro Tsuruta, Nara (JP); Junichi Kajiwara, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1661 days.

(21) Appl. No.: 12/047,804

(22) Filed: Mar. 13, 2008

(65) Prior Publication Data

US 2008/0226330 A1 Sep. 18, 2008

(30) Foreign Application Priority Data

Mar. 15, 2007 (JP) ..... 2007-067018

(51) Int. Cl.
*G03G 15/20* (2006.01)

(52) U.S. Cl.
USPC ..... 219/216; 219/483; 219/486; 399/69; 399/70

(58) Field of Classification Search
CPC ..... G03G 15/20; G03G 15/2014; G03G 15/2017; G03G 15/2039; G03G 15/2053
USPC ..... 219/476, 482, 483, 486, 494, 619, 656, 219/660–662, 665; 399/67, 69, 70
See application file for complete search history.

(56) References Cited

U.S. PATENT DOCUMENTS

| | | | | |
|---|---|---|---|---|
| 2002/0043523 | A1* | 4/2002 | Fujita et al. | 219/216 |
| 2006/0222395 | A1* | 10/2006 | Yoda | 399/69 |
| 2006/0237446 | A1* | 10/2006 | Kishi et al. | 219/619 |

FOREIGN PATENT DOCUMENTS

| | | | |
|---|---|---|---|
| JP | 2004-266984 | A | 9/2004 |
| JP | 2004-286869 | A | 10/2004 |
| JP | 2004-294554 | A | 10/2004 |
| JP | 2005-221697 | A | 8/2005 |
| JP | 2006-324226 | A | 11/2006 |
| JP | 2007-41232 | A | 2/2007 |

* cited by examiner

*Primary Examiner* — Brian Jennison
(74) *Attorney, Agent, or Firm* — Birch, Stewart, Kolasch & Birch, LLP

(57) ABSTRACT

An apparatus for image formation comprises a fixing unit, first to fourth switching units, a DC power supply unit, an accumulating unit, a charging unit, and a switching control unit. The first switching unit switches the state of connection between the fixing unit and a commercial power source. The DC power supply unit supplies another electric load of the apparatus than the fixing unit with DC power. The second switching unit switches the state of connection between the DC power supply unit and the commercial power source. The third switching unit switches the state of connection between the charging unit and the commercial power source. The fourth switching unit switches the state of connection between the accumulating unit and the electric load. Based on the state of conduction of the first switching unit, the switching control unit switches the states of conduction of the other three switching units.

11 Claims, 9 Drawing Sheets

APPARATUS FOR IMAGE FORMATION

CROSS REFERENCE

This Nonprovisional application claims priority under 35 U.S.C. §119(a) on Patent Application No. 2007-067018 filed in Japan on Mar. 15, 2007, the entire contents of which are hereby incorporated by reference.

BACKGROUND OF THE INVENTION

The present invention relates to an apparatus for electrophotographic image formation which includes a fixing unit for fixing a toner image on a sheet.

A problem with the speedup of an apparatus for electrophotographic image formation is the prevention of the heat shortage in the fixing unit of the apparatus, because, if the number of sheets which pass through this unit per unit time is larger they take away more of the heat accumulated in the unit.

The heat shortage in the fixing unit could be prevented by supplying more power from a commercial power source to the apparatus. However, troublesome interior wiring work is required to raise the upper limit of the power supplied from the power source.

For example, each of JP 2004-286869 A and JP 2004-294554 A discloses a conventional apparatus for electrophotographic image formation, in which the condenser or accumulator supplies power to the fixing unit so as to prevent the heat shortage in this unit. According to these publications, it is possible to shorten the warm-up time for the fixing unit. This shortens the fast copy time for the apparatus, so that the apparatus is sped up.

It is preferable to prevent the heat shortage in the fixing unit of an apparatus for electrophotographic image formation in such a manner that the apparatus can perform printing without interruption for a longer period, because printing interruption is a nuisance. Therefore, it is preferable that more sheets pass through the fixing unit per unit time, and that the apparatus be able to perform printing without interruption for a longer period.

The object of the present invention is to provide an apparatus for image formation having a simple structure which prevents the power supply to the fixing unit of the apparatus from being short while the apparatus is doing printing without interruption.

SUMMARY OF THE INVENTION

An apparatus for electrophotographic image formation according to the present invention includes a fixing unit for fixing a toner image on a sheet. The apparatus further includes a first switching unit, a DC power supply unit, a second switching unit, an accumulating unit, a charging unit, a third switching unit, a fourth switching unit, and a switching control unit.

The first switching unit changes its state of conduction to switch the state of connection between the fixing unit and a commercial power source. Typically, this switching unit may be a triac, which controls the state of connection between the fixing unit and the power source. Alternatively, this switching unit may be an on-off switch.

The DC power supply unit supplies another electric load of the apparatus than the fixing unit with DC power based on the power from the commercial power source. The DC power supply unit may be a rectifying circuit, which converts AC power to DC power.

The second switching unit changes its state of conduction to switch the state of connection between the DC power supply unit and the commercial power source. This switching unit may be an on-off relay switch, via which the DC power supply unit and the commercial power source are wired together.

The accumulating unit accumulates DC power to be supplied to the electric load. The accumulating unit may be a condenser. It is preferable that the accumulating unit be an electric double layer condenser in order to accumulate much power.

The charging unit charges the accumulating unit based on the power from the commercial power source. The charging unit may rectify the AC power from the power source and charge the accumulating unit under a procedure meeting the specifications for the accumulating unit.

The third switching unit changes its state of conduction to switch the state of connection between the charging unit and the commercial power source. This switching unit may be an on-off relay switch, via which the charging unit and the power source are wired together.

The fourth switching unit changes its state of conduction to switch the state of connection between the accumulating unit and the electric load. This switching unit may be a transistor, via which the accumulating unit and the electric load are wired together.

The switching control unit controls the four switching units. Based on the state of conduction of the first switching unit, the switching control unit switches the states of conduction of the other three switching units. The switching control unit may make the second and third switching units nonconductive and the fourth switching unit conductive when the first switching unit is conductive. The switching control unit may make the second and third switching units conductive and the fourth switching unit nonconductive when the first switching unit is nonconductive.

By providing the switching control unit, power can be supplied from the commercial power source to the fixing unit, with the accumulating unit connected to the electric load, and with the DC power supply unit and the charging unit disconnected from the source. This makes it possible to supply the fixing unit with substantially all the power supplied from the commercial power source. As a result, without raising the upper limit of the power supplied from the commercial power source, it is easy to both maintain the fixing temperature and supply the electric load with power. In addition, the power supplied to the fixing unit is less liable to be short while the apparatus is performing printing without interruption. This makes the apparatus less liable to interrupt high-speed printing due to a heat shortage in the fixing unit.

Each of FIGS. 4-9 is a flowchart of an operation procedure performed by the main control unit of the apparatus.

DETAILED DESCRIPTION OF THE INVENTION

Figure 1:
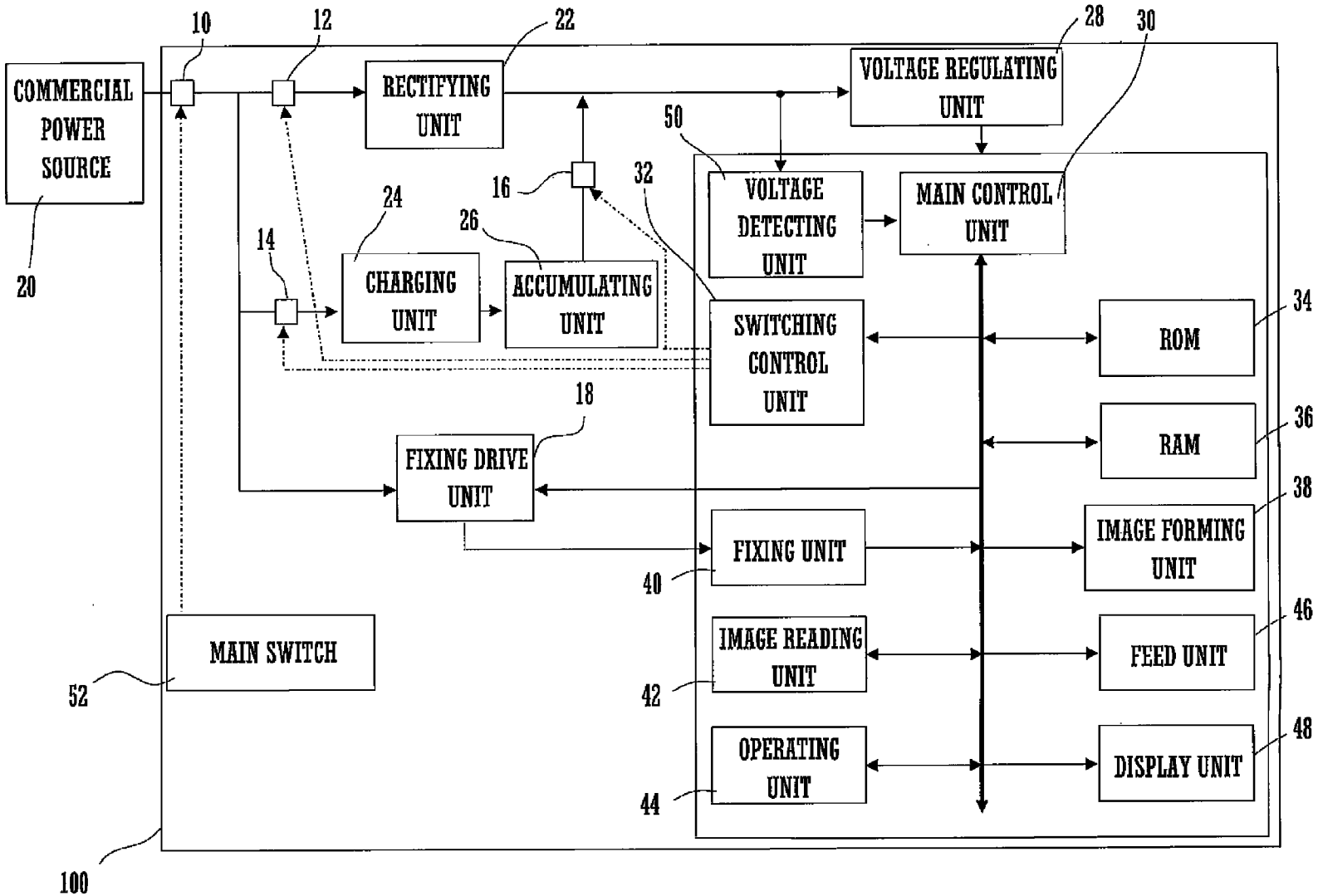
FIG. 1 is a schematic block diagram of an apparatus for image formation embodying the present invention.

FIG. 1 shows an apparatus 100 for image formation which embodies the present invention. The apparatus 100 includes a main switch 52, which makes a first connector 10 conductive or nonconductive. The first connector 10 switches on or off the power supply from a commercial power source 20.

The apparatus 100 further includes a main control unit 30, which is connected to ROM 34, a RAM 36, an image forming unit 38, a feed unit 46, a display unit 48, an operating unit 44, an image reading unit 42, a fixing unit 40, a fixing drive unit 18, a switching control unit 32, and a voltage detecting unit 50.

The ROM 34 stores the programs necessary for the operation of the main control unit 30. The RAM 36 is a volatile memory for temporarily holding data. The feed unit 46 feeds a sheet along the feed passage formed in the apparatus 100. The image forming unit 38 forms an image electrophotographically on the sheet being fed by the feed unit 46. The display unit 48 displays information for the user of the apparatus 100. The user enters information etc. into the apparatus 100 through the operating unit 44. The image reading unit 42 reads the image on the document placed on the document platform in the apparatus 100 and generates data.

Figure 2A:
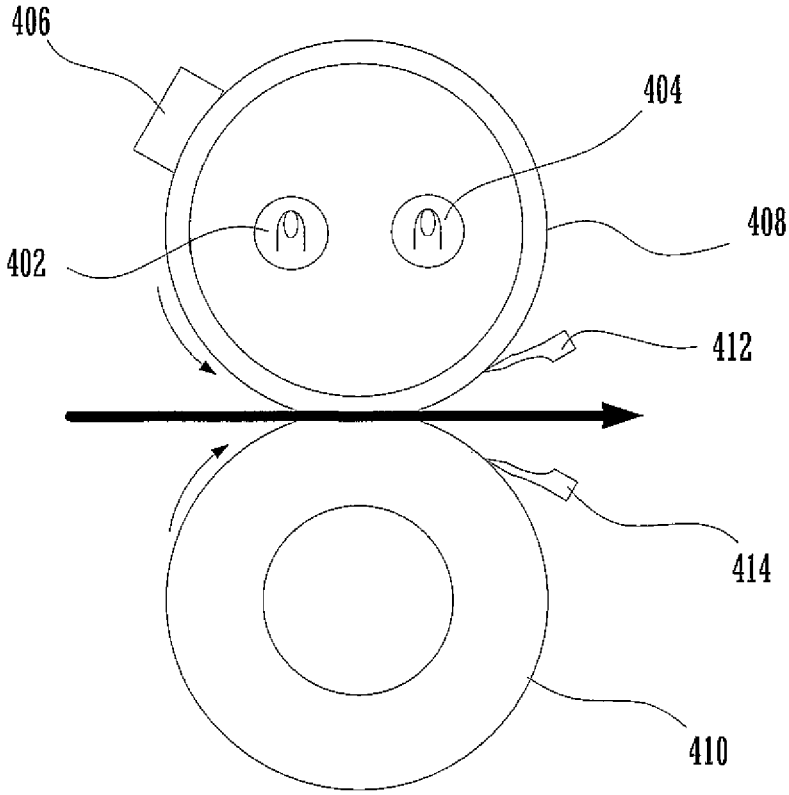
FIG. 2A is a sectional view of the fixing unit of the apparatus.
Figure 2B:
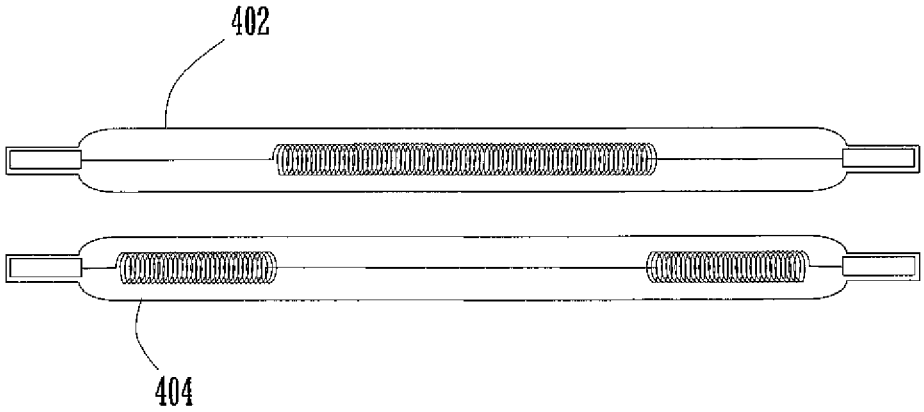
FIG. 2B is a sectional view of the heaters of the fixing unit.

The fixing drive unit 18, which corresponds to the first switching unit of the present invention, controls the fixing unit 40 in accordance with signals from the main control unit 30. The fixing unit 40 fixes the toner image on a sheet with heat under pressure. As shown in FIG. 2A, the fixing unit 40 includes a heating roller 408, a press roller 410, a thermistor 406, and sheet release nails 412 and 414. The heating roller 408 is fitted with a first heater 402 and a second heater 404 in it. As shown in FIG. 2B, the heaters 402 and 404 have structures which make their heating characteristics different.

With reference to FIG. 1, the switching control unit 32 changes the states of conduction of a second connector 12, a third connector 14, and a fourth connector 16 in accordance with signals from the main control unit 30. The second connector 12, the third connector 14, and the fourth connector 16 correspond to the second switching unit, the third switching unit, and the fourth switching unit, respectively.

Figure 3:
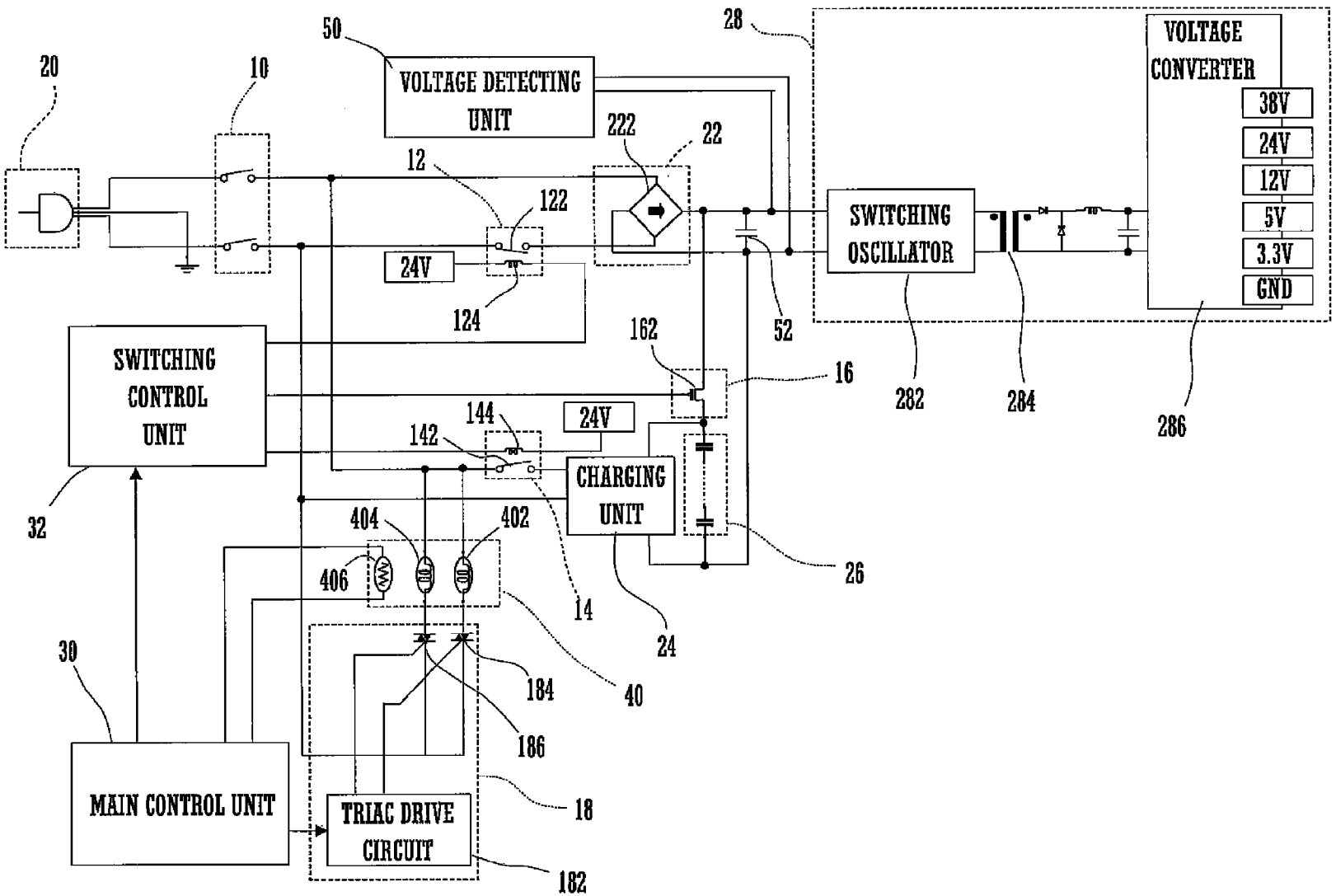
FIG. 3 is a diagram of a structure for controlling the power supply to the apparatus.
Figure 4:
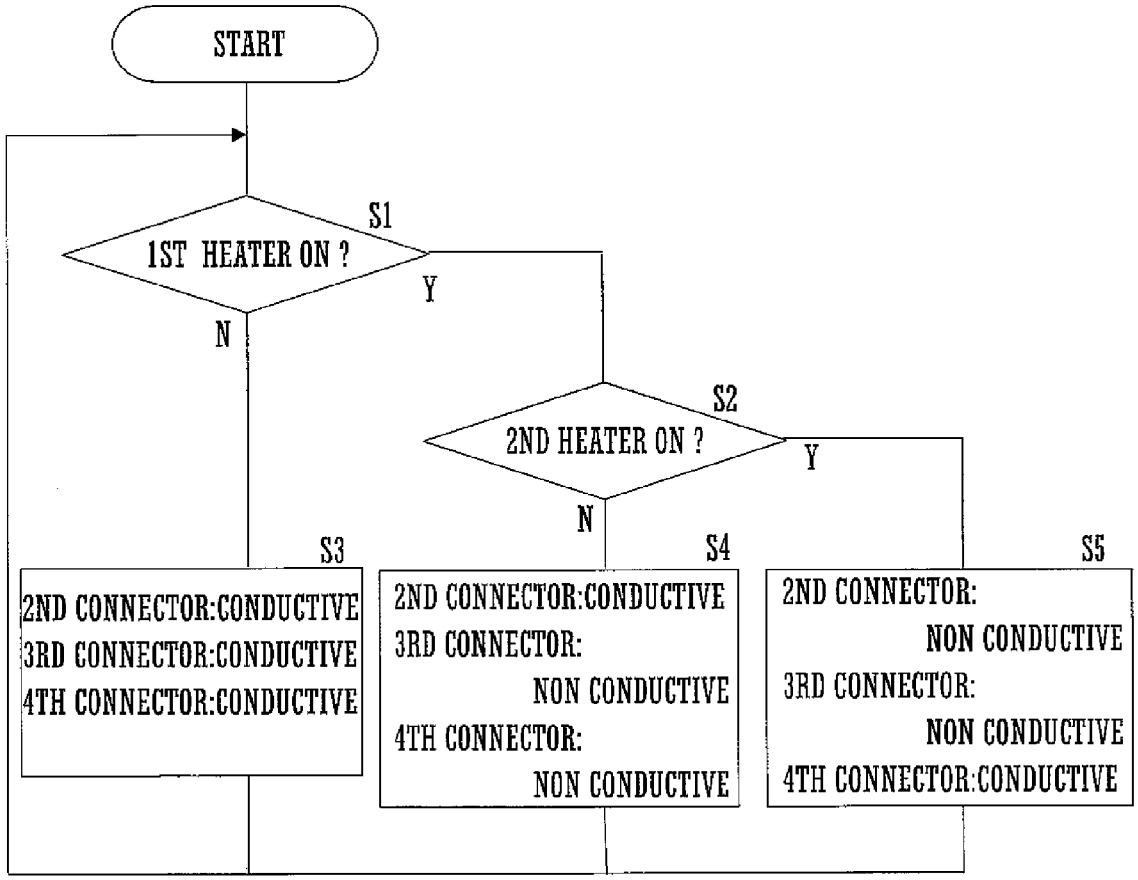

The commercial power source 20 is wired via the first connector 10 and second connector 12 with a rectifying unit 22, which is connected to a voltage regulating unit 28. As shown in FIG. 3, the rectifying unit 22 includes a diode bridge 222, and the voltage regulating unit 28 includes a switching oscillator 282, a transformer 284, and a voltage converter 286. The voltage regulating unit 28 converts the power from the power source 20 and supplies DC power to the main control unit 30 and switching control unit 32, which are control system circuits, and to the image forming unit 38 and image reading unit 42, which are drive system circuits.

The commercial power source 20 is wired via the first connector 10 and third connector 14 with a charging unit 24, which is connected to an accumulating unit 26. The charging unit 24 rectifies the AC power from the power source 20 and makes the accumulating unit 26 accumulate DC power. The accumulating unit 26 is an electric double layer condenser which can be charged by the charging unit 24.

The accumulating unit 26 is wired via the fourth connector 16 with the voltage regulating unit 28 and voltage detecting unit 50. The voltage detecting unit 50 detects the power accumulated by the accumulating unit 26 and outputs the result of the detection to the main control unit 30.

With reference to FIG. 3, it is described below how to change the states of conduction of the connectors 12, 14, and 16.

The switching control unit 32 so controls the second connector 12 as to switch on or off the power supply from the commercial power source 20 to the rectifying unit 22. This connector 12 includes a relay switch 122 and a relay coil 124. One terminal of the relay switch 122 is connected to the first connector 10, and the other terminal is connected to the diode bridge 222. On end of the relay coil 124 is connected to the voltage converter 286, and the other end is connected to the switching control unit 32. The switching control unit 32 turns on or off the relay switch 122 by selectively making the relay coil 124 supplied with power.

The switching control unit 32 so controls the third connector 14 as to switch on or off the power supply from the commercial power source 20 to the charging unit 24. This connector 14 includes a relay switch 142 and a relay coil 144. One terminal of the relay switch 142 is connected to the first connector 10, and the other terminal is connected to the charging unit 24. On end of the relay coil 144 is connected to the voltage converter 286, and the other end is connected to the switching control unit 32. The switching control unit 32 turns on or off the relay switch 142 by selectively making the relay coil 144 supplied with power.

The switching control unit 32 so controls the fourth connector 16 as to switch on or off the power supply from the accumulating unit 26 to the voltage regulating unit 28. This connector 16 includes an FET 162, the gate of which is connected to the switching control unit 32. The switching control unit 32 controls the power supply from the accumulating unit 26 to the is voltage regulating unit 28 by controlling the voltage applied to the gate of the FET 162.

As shown in FIG. 3, the fixing drive unit 18 includes triacs 184 and 186 and a triac drive circuit 182. The first connector 10 is connected via the triacs 184 and 186 to the heaters 402 and 404 respectively of the fixing unit 40. The drive circuit 182 controls the states of conduction of the triacs 184 and 186 in accordance with signals from the main control unit 30.

The main control unit 30 detects the surface temperature of the heating roller 408 of the fixing unit 40 by means of the thermister 406 of this unit and so controls the power supply to the heaters 402 and 404 of this roller that this temperature ranges between 160 and 180 degrees C. The main control unit 30 informs the switching control unit 32 about the controlled supply. Based on the information about the controlled supply, the switching control unit 32 controls the states of conduction of the connectors 12, 14, and 16.

Specifically, when the triacs 184 and 186 are conductive, the switching control unit 32 turns off the connectors 12 and 14 and makes the connector 16 conductive. When the triacs 194 and 186 are nonconductive, the switching control unit 32 turns on the connectors 12 and 14 and makes the connector 16 nonconductive. As a result, while the heaters 402 and 404 are supplied with power, the voltage regulating unit 28 is disconnected from the commercial power source 20, and the accumulating unit 26 charged in advance activates the electric circuits other than the fixing unit 40. While the heaters 402 and 404 are not supplied with power, the voltage regulating unit 28 is connected to the power source 20, so that source 20 supplies power to the electric circuits other than the fixing unit 40. In the meantime, the power from the source 20 charges the accumulating unit 26.

The commercial power source 20 can supply a power of 1.5 kw, all of which can substantially be supplied to the heaters 402 and 404. This prevents the apparatus 100 from consuming power higher than the set value of 1.5 kw, so that the surface temperature of the heating roller 408 is easy to maintain. As a result, the apparatus 100 can perform high-speed printing without interruption.

FIGS. 4-9 show other operation procedures performed by the main control unit 30. First, with reference to FIG. 4, a description is provided below of a method for controlling the states of conduction of the connectors 12, 14, and 16 based on whether the heaters 402 and 404 are supplied with power.

The main control unit 30 determines at step S1 whether the first heater 402 is supplied with power. If it is determined at step S1 that this heater 402 is not supplied with power, the main control unit 30 so controls the switching control unit 32 at step S3 as to turn on the second connector 12 and third connector 14 and make the fourth connector 16 nonconductive. As a result, if the heaters 402 and 404 are not supplied with power, the voltage regulating unit 28 and charging unit 24 are supplied with power from the commercial power source 20.

If it is determined at step S1 that the first heater 402 is supplied with power, the main control unit 30 determines at step S2 whether the second heater 404 is supplied with power. If it is determined at step S2 that the second heater 404 is not supplied with power, the main control unit 30 so controls the switching control unit 32 at step S4 as to turn on the second connector 12, turn off the third connector 14, and make the fourth connector 16 nonconductive. As a result, if only the first heater 402 is supplied with power, only the voltage regulating unit 28 is supplied with power from the commercial power source 20, while the charging unit 24 is not supplied with power.

If it is determined at step S2 that the second heater 404 is supplied with power, the main control unit 30 so controls the switching control unit 32 at step S5 as to turn off the second connector 12 and third connector 14 and make the fourth connector 16 conductive. As a result, if the heaters 402 and 404 are supplied with power, the power supply from the commercial power source 20 to the voltage regulating unit 28 and charging unit 24 is shut off, and the accumulating unit 26 supplies power to the electric circuits other than the fixing unit 40.

Figure 5:
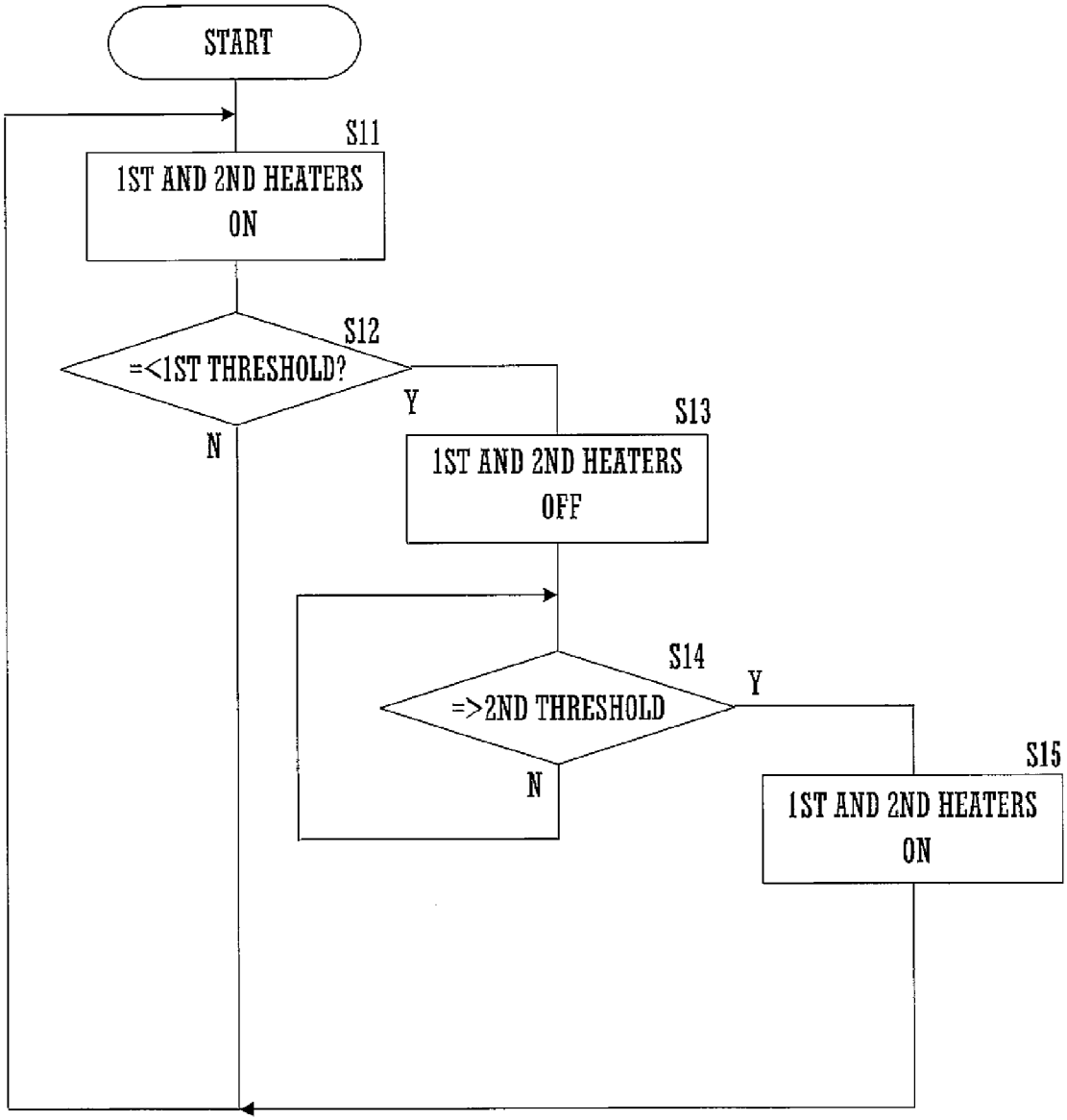

Subsequently, with reference to FIG. 5, a description is provided below of a process for stopping the power supply to the fixing unit 40. Because an electric double layer condenser generally has sufficient capacitance, it is considered that the electric circuits other than the fixing unit 40 can be supplied with sufficient power while the apparatus 100 is doing printing without interruption. However, if the electric energy accumulated by the electric double layer condenser 26 were not sufficient, the main control unit 30 could not be supplied with power and might not operate while the apparatus 100 is doing printing without interruption. This can be prevented by the voltage detecting unit 50, which detects the voltage across the accumulating unit 26.

If the heaters 402 and 404 are supplied with power (S11), the main control unit 30 determines at step S12 whether the voltage across the accumulating unit 26 is equal to or lower than a first threshold. If it is determined at step S12 that the voltage is equal to or lower than the first threshold, the main control unit 30 stops the power supply to the heaters 402 and 404 at step S13. This secures power supply from the commercial power source 20 to the electric circuits other than the fixing unit 40. In this case, the operation of the whole apparatus 100 is prevented from stopping, although the printing speed of the apparatus decreases because the surface temperature of the heating roller 408 cannot be maintained.

After the main control unit 30 stops the power supply to the heaters 402 and 404 at step S13, it keeps stopping the power supply to them until the voltage across the accumulating unit 26 reaches a second threshold. Specifically, at step S14, the main control unit 30 determines whether the voltage across the accumulating unit 26 is equal to or higher than the second threshold. If it is confirmed at step S14 that the voltage is equal to or higher than the second threshold, the main control unit 30 makes the heaters 402 and 404 supplied with power at step S15. In view of hysteresis characteristics, the second threshold is higher than the first threshold.

Figure 6:
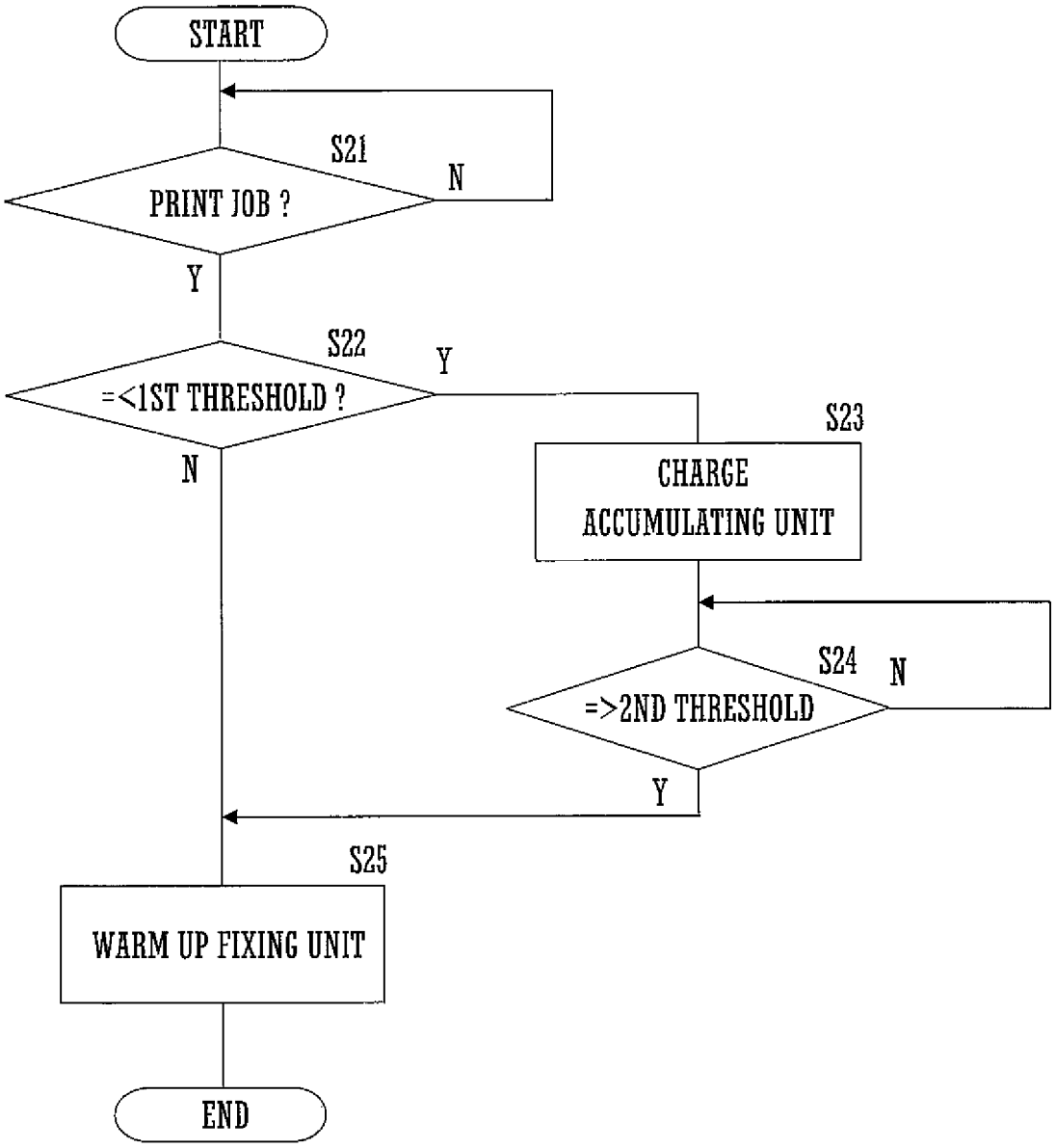

Subsequently, with reference to FIG. 6, a description is provided below of an operation procedure performed by the main control unit 30 when the fixing unit 40 warms up. The main control unit 30 stands by until it receives a print job. Specifically, at step S21, the main control unit 30 determines whether it has received a print job. If the main control unit 30 receives a print job at step S21, it determines at step S22 whether the voltage across the accumulating unit 26 is equal to or lower than the first threshold.

If it is determined at step S22 that the voltage across the accumulating unit 26 is higher than the first threshold, the operation procedure goes immediately to a warm-up step S25. If it is determined at step S22 that the voltage is equal to or lower than the first threshold, the main control unit 30 makes the accumulating unit 26 charged at step S23 prior to the warm-up step. The main control unit 30 determines at step S24 whether the voltage across the charged accumulating unit 26 is equal to or higher than the second threshold. If it is determined at step S24 that the voltage is equal to or higher than the second threshold, the procedure goes to the warm-up step S25. The charging of the accumulating unit 26 prior to the warm-up step makes this unit less liable to be unable to accumulate power while the apparatus 100 is doing printing without interruption.

Figure 7:
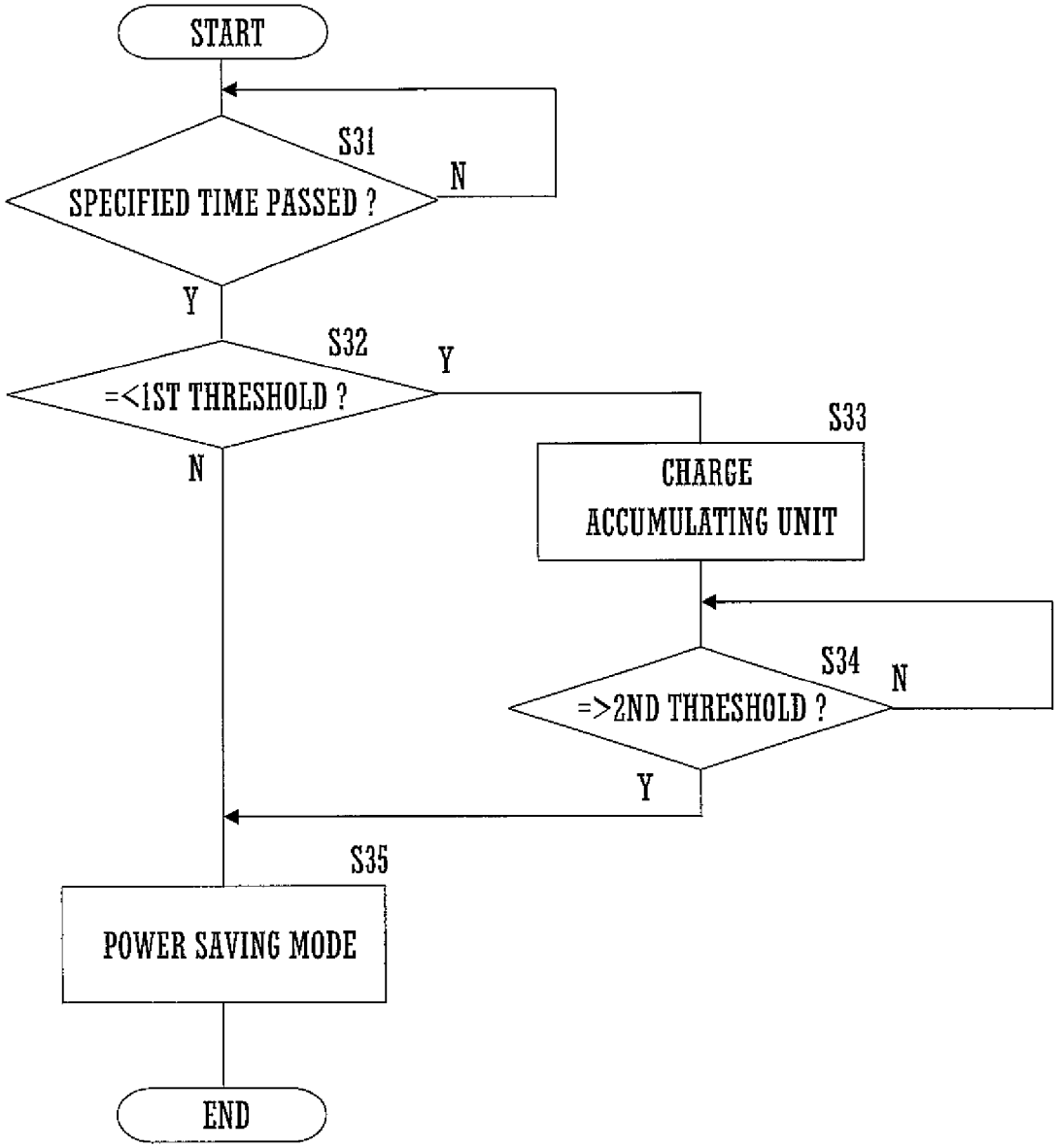

Subsequently, with reference to FIG. 7, a description is provided below of the operation procedure performed by the main control unit 30 when the apparatus 100 changes over to a power saving mode. The main control unit 30 determines at step S31 whether a specified time has passed after the completion of the previous job. If it is determined at step S31 that the specified time has passed, the main control unit 30 determines at step S32, before it makes the apparatus 100 change over to the power saving mode, whether the voltage across the accumulating unit 26 is equal to or lower than the first threshold.

If it is determined at step S32 that the voltage across the accumulating unit 26 is higher than the first threshold, the main control unit 30 immediately makes the apparatus 100 change over to the power saving mode at step S35. If it is determined at step S32 that the voltage is equal to or lower than the first threshold, the main control unit 30 makes the accumulating unit 26 charged at step S33 before this control unit makes the apparatus 100 change over to the power saving mode. The main control unit 30 determines at step S34 whether the voltage across the charged accumulating unit 26 is equal to or higher than the second threshold. If it is determined at step S34 that the voltage is equal to or higher than the second threshold, the main control unit 30 makes the apparatus 100 change over to the power saving mode at step S35. Because the charging of the accumulating unit 26 is completed before the apparatus 100 changes over to the power saving mode, the accumulating unit does not need to be charged in this mode. As a result, the power consumption in the power saving mode decreases.

Figure 8:
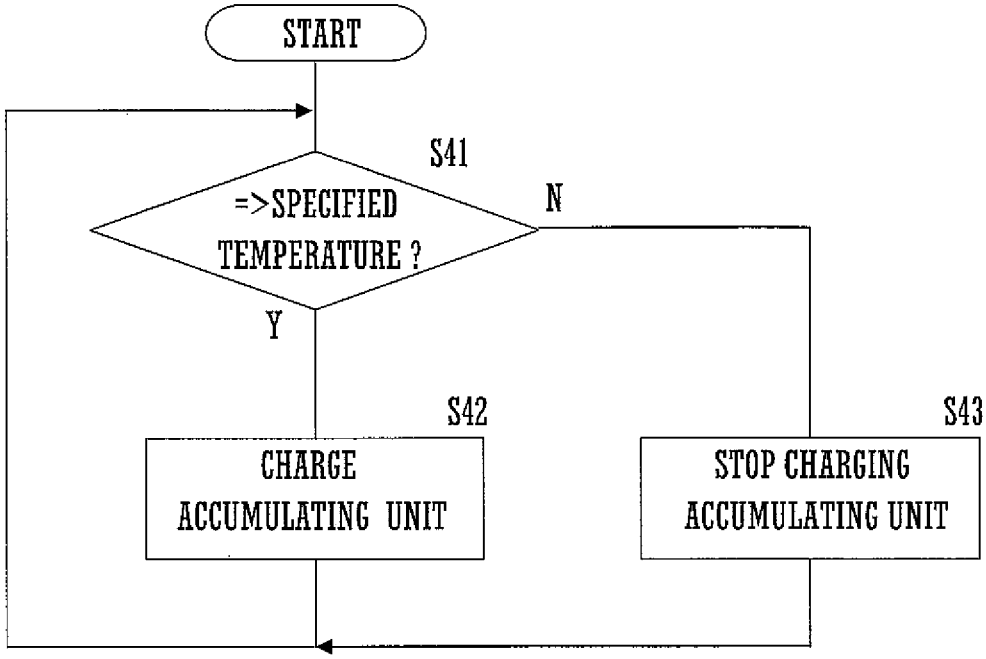

Subsequently, with reference to FIG. 8, it is described below how to switch the charging of the accumulating unit 26. The main control unit 30 selectively makes the heaters 402 and 404 of the fixing unit 40 supplied with power. The subtraction of the power supplied to the heaters 402 and 404 from the power supplied from the commercial power source 20 gives a surplus power, which charges the accumulating unit 26.

The main control unit 30 determines at step S41 whether the temperature detected by means of the thermistor 406 of the fixing unit 40 is equal to or higher than a specified value.

If it is determined at step S41 that the temperature is equal to or higher than the specified value, the main control unit 30 makes the accumulating unit 26 charged at step S42. If it is determined at step S41 that the temperature is lower than the specified value, the main control unit 30 stops at step S43 the accumulating unit 26 from being charged. This enables the accumulating unit 26 to be charged by the surplus power while the power supply to the fixing unit 40 is low.

Figure 9:
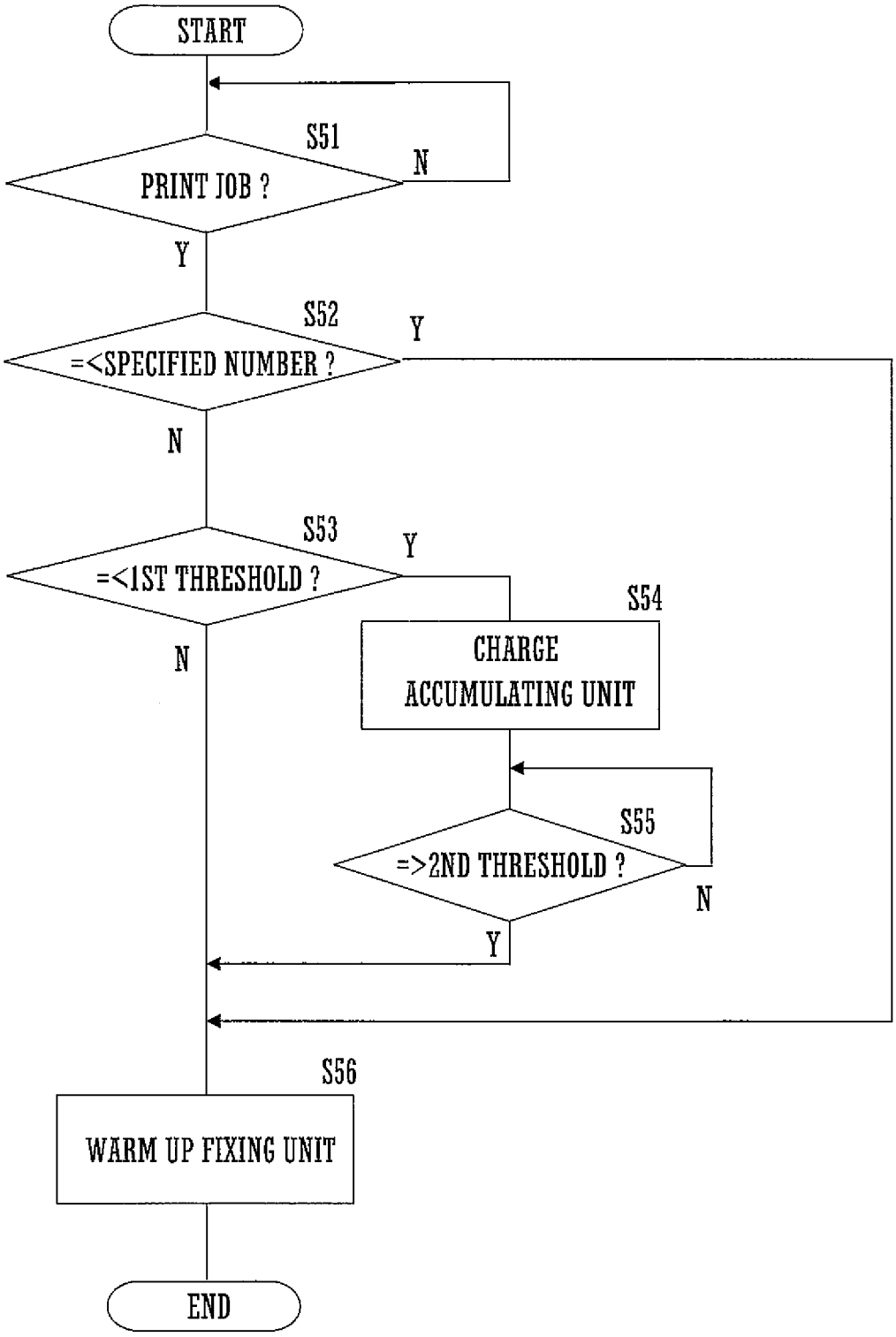

Subsequently, with reference to FIG. 9, a description is provided below of another operation procedure performed by the main control unit 30 when the fixing unit 40 warms up. The main control unit 30 stands by until it receives a print job. Specifically, at step S51, the main control unit 30 determines whether it has received a print job. If the main control unit 30 receives a print job at step S51, it determines at step S52 whether the job requests sheets not more than a specified number to be printed. For example, the specified number is three if the sheets are of A4 size. If it is determined at step S52 that the print job requests sheets not more than the specified number to be printed, the operation procedure goes immediately to a warm-up step S56, and the main control unit 30 starts a printing process. This shortens the fast copy time if the apparatus 100 prints a small number of sheets.

If it is determined at step S52 that the print job requests sheets more than the specified number to be printed, the main control unit 30 determines at step S53 whether the voltage across the accumulating unit 26 is equal to or lower than the first threshold.

If it is determined at step S53 that the voltage across the accumulating unit 26 is higher than the first threshold, the operation procedure goes immediately to a warm-up step S56. If it is determined at step S53 that the voltage is equal to or lower than the first threshold, the main control unit 30 makes the accumulating unit 26 charged at step S54 prior to the warm-up step. The main control unit 30 determines at step S55 whether the voltage across the charged accumulating unit 26 is equal to or higher than the second threshold. If it is determined at step S55 that the voltage is equal to or higher than the second threshold, the operation procedure goes to the warm-up step S56.

The present invention being thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for electrophotographic image formation comprising:

an electric load;

a fixing unit for fixing a toner image on a sheet;

a first heater and a second heater incorporated in the fixing unit, driven based on power from a commercial power source, and independently supplied with or without power;

a first switching unit capable of changing a connection status between the fixing unit and the commercial power source;

a DC power supply unit for supplying the electric load other than the fixing unit with DC power based on the power from the commercial power source;

a second switching unit capable of changing a connection status between the DC power supply unit and the commercial power source;

an accumulating unit capable of accumulating DC power to be supplied to the electric load other than the fixing unit;

a charging unit for charging the accumulating unit based on the power from the commercial power source;

a third switching unit capable of changing a connection status between the charging unit and the commercial power source;

a fourth switching unit capable of changing a connection status between the accumulating unit and the electric load;

a switching control unit for controlling the four switching units; and a main control unit for controlling the switching control unit based on a state where the first heater and the second heater are supplied with power;

wherein the switching control unit switches the connection status of the second, third, and fourth switching units based on the connection status of the first switching unit; and wherein the main control unit inhibits both the accumulating unit and the DC power supply unit from being supplied with power when the main control unit makes the first heater and the second heater supplied with power, inhibits the accumulating unit from being supplied with power and makes the DC power supply unit supplied with power when the main control unit makes the first heater supplied with power and the second heater supplied with no power, and makes both the accumulating unit and the DC power supply unit supplied with power when the main control unit makes the first heater and the second heater supplied with no power.

2. An apparatus for electrophotographic image formation as claimed in claim 1, wherein the switching control unit switches the second and third switching units into an unconnected status and the fourth switching unit into a connected status when the first switching unit is in a connected status, and wherein the switching control unit switches the second and third switching units into a connected status and the fourth switching unit into an unconnected status when the first switching unit is in an unconnected status.

3. An apparatus for electrophotographic image formation as claimed in claim 2, further comprising a detecting unit for detecting the electric energy accumulated by the accumulating unit;

wherein the switching control unit switches the first switching unit into an unconnected status if the detected energy is not higher than a first threshold.

4. An apparatus for electrophotographic image formation as claimed in claim 3, wherein the switching control unit returns the first switching unit into a connected status at that time when the detected energy is over a second threshold higher than the first threshold.

5. An apparatus for electrophotographic image formation as claimed in claim 1, wherein the accumulating unit is an electric double layer condenser.

6. An apparatus for electrophotographic image formation as claimed in claim 3, wherein the main control unit acquires the electric energy detected by the detecting unit before the fixing unit is warmed up; and wherein the main control unit controls the switching control unit in such a manner that, if the acquired energy is not higher than the first threshold, the accumulating unit is charged before the fixing unit is warmed up.

7. An apparatus for electrophotographic image formation as claimed in claim 3, wherein, if the apparatus is required to print sheets not more than a specified number, the main control unit makes the fixing unit to warm up prior to the charging of the accumulating unit regardless of the electric energy detected by the detecting unit before the fixing unit is warmed up.

8. An apparatus for electrophotographic image formation as claimed in claim 3, wherein the main control unit acquires the electric energy detected by the detecting unit before the apparatus changes over to a power saving mode; and wherein the main control unit controls the switching control unit in such a manner that, if the acquired energy is not higher than the first threshold, the accumulating unit is charged before the apparatus changes over to the power saving mode.

9. An apparatus for electrophotographic image formation as claimed in claim 3, wherein the fixing unit includes:

a heating roller for heating a sheet and a thermister for sensing the surface temperature of the heating roller; and wherein the main control unit controls the switching control unit in such a manner that the accumulating unit is charged at that time when the sensed temperature is over a specified value.

10. An apparatus for electrophotographic image formation as claimed in claim 1, wherein the fixing unit includes a first heater and a second heater.

11. An apparatus for electrophotographic image formation as claimed in claim 10, wherein the main control unit selectively makes the two heaters supplied with power.

* * * * *